US006435156B1

(12) United States Patent
Copus

(10) Patent No.: US 6,435,156 B1
(45) Date of Patent: Aug. 20, 2002

(54) SYSTEM AND METHOD FOR DISABLING CYLINDERS IN AN INTERNAL COMBUSTION ENGINE

(76) Inventor: David A. Copus, 290 E. Heather Cir., Orem, UT (US) 84057

( * ) Notice: Subject to any disclaimer, the term of this patent is extended or adjusted under 35 U.S.C. 154(b) by 0 days.

(21) Appl. No.: 09/652,342

(22) Filed: Aug. 31, 2000

(51) Int. Cl.[7] ..... F02B 77/00
(52) U.S. Cl. ..... 123/198 F
(58) Field of Search ..... 123/198 F

(56) References Cited

U.S. PATENT DOCUMENTS

| | | | | |
|---|---|---|---|---|
| 4,111,165 A | | 9/1978 | Aoyama | |
| 4,161,166 A | * | 7/1979 | Roznovsky | 123/198 F |
| 4,204,512 A | * | 5/1980 | Brock | 123/198 F |
| 4,252,093 A | * | 2/1981 | Hazelrigg | 123/198 F |
| 4,256,070 A | * | 3/1981 | Mueller | 123/198 F |
| 4,401,069 A | * | 8/1983 | Foley | 123/198 F |
| 4,615,306 A | | 10/1986 | Wakeman | |
| 4,991,558 A | | 2/1991 | Daly et al. | |
| 5,035,220 A | | 7/1991 | Uchinami et al. | |
| 5,038,739 A | | 8/1991 | Ishii | |
| 5,117,790 A | * | 6/1992 | Clarke et al. | 123/198 F |
| 5,954,018 A | * | 9/1999 | Joshi | 123/198 F |

FOREIGN PATENT DOCUMENTS

GB 2 122 582 A 5/1983

* cited by examiner

*Primary Examiner*—Noah P. Kamen
(74) *Attorney, Agent, or Firm*—Thorpe North & Western, LLP

(57) ABSTRACT

A system and method of disabling at least one cylinder in a multiple cylinder combustion engine is disclosed wherein the fuel combustion air intake valve is closed such that essentially no fuel enters the cylinder, and the exhaust valve is opened such that the piston can move essentially unimpeded. This is accomplished by disabling the rocker arms associated with each cylinder valve, preferably by a pair of auxiliary cams which can be computer controlled, or be operated by the driver. Additionally, a circuit for disabling power to a cylinder or engine while maintaining power to other operational loads is disclosed.

21 Claims, 3 Drawing Sheets

SYSTEM AND METHOD FOR DISABLING CYLINDERS IN AN INTERNAL COMBUSTION ENGINE

FIELD OF THE INVENTION

The present invention is related to systems and methods for disabling one or more cylinders in an internal combustion engine while other systems remain operational.

BACKGROUND OF THE INVENTION

It is known in the auto industry that during different operational modes, different amounts of power are required. For example, at idle conditions compared to high performance conditions, different power is required from the engine. Since valves are typically controlled by cam systems which are generally fixed, compromises have been made which lean toward normal load or speed ranges. Thus, it is typical that excessive engine power is being produced at certain times, particularly during idle and other low power modes.

Various systems have been designed to compensate for different operational loads. For example in U.K. Patent Application GB 2 122 682 A, a multiple-displacement engine is disclosed. There, the number of operating cylinders changes according to the load by cutting off fuel supply to some cylinders. Specifically, the fuel injection control circuit cuts off the fuel to cylinders on a random or sequential basis, depending on engine load.

Additionally, in U.S. Pat. No. 5,035,220, a fuel controller is disclosed wherein a sensor detects misfiring in a cylinder. Thus, when the cylinder misfires, the fuel injector corresponding to the misfiring cylinder is prevented from supplying fuel to the misfiring cylinder. Though this is not designed to adjust itself based upon power requirements, the concept of shutting down a cylinder is practiced in response to malfunction.

In U.S. Pat. No. 4,991,558, the operation of a multiple cylinder two-stroke internal combustion engine is disclosed wherein the engine is operated at idle by interrupting the fuel injection stages in a predetermined pattern. Thus, over several crankshaft revolutions, fewer number of injections occur, saving fuel. Similarly, in U.S. Pat. No. 5,038,739, a multi-cylinder two-cycle engine is disclosed wherein fuel is injected and ignited at less than typical intervals. Thus, at least one piston stroke for each cylinder occurs during which no combustion takes place. Additionally, fresh air is pumped through the combustion chamber to scavenge residual combustion gases therefrom.

There have also been systems developed which completely disable the operation of certain valves during different modes of operation. In U.S. Pat. No. 4,111,165, the concept of changing the valve lift and valve timing of the intake and exhaust valves of an internal combustion engine is disclosed. Specifically, the intake and exhaust valves are maintained in a closed position during deceleration of the engine. Another example of such a design is the Cadillac 8-6-4 engine. This design utilizes very high powered solenoids in order to disable the valves and maintain their disabled state. However, such solenoids are very expensive and can become a dashpot that robs the rest of the engine of power. This is because constant power is required to maintain the solenoid activation.

Thus, with regard to the concept of completely disabling one or more cylinders, it would be desirable to provide an inexpensive system for disabling one or more cylinders in an internal combustion engine without sacrificing any significant amount of power.

SUMMARY OF THE INVENTION

The present invention provides systems and methods of disabling cylinders in an internal combustion engine.

Specifically, a method of disabling at least one cylinder for at least one complete engine cycle in a multiple cylinder combustion engine is disclosed which comprises closing a fuel combustion air intake valve associated with at least one cylinder such that essentially no fuel enters the at least one cylinder, opening an exhaust valve associated with the at least one cylinder such that piston movement within the cylinder is essentially unimpeded, and allowing at least one complete engine cycle to occur while both the fuel combustion air intake valve is closed and the exhaust valve is open.

Additionally, a system for disabling at least one cylinder in a multiple cylinder combustion engine is disclosed. This system comprises a first rocker arm associated with opening and closing of a fuel combustion air intake valve wherein the first rocker arm has an operational position and a disabled position, a second rocker arm associated with opening and closing of an exhaust valve wherein the second rocker arm has an operational position and a disabled position, and a switch for toggling the first and second rocker arms from their respective operational positions to their respective disabled positions. The rocker arms (and thus the valves) are preferably disabled by a pair of auxiliary cams that can be rotated to effectuate this result.

Alternatively, a circuit for disabling power to an engine while maintaining power to other operational loads is disclosed. This circuit comprises an ignition switch and a plurality of parallel circuits electrically coupled to the ignition switch wherein the plurality of parallel circuits branch out from a common branched circuit region. A parallel spark plug power circuit branched from the common branched circuit region electrically couples the engine to the ignition switch. An interrupter switch is also positioned on the spark plug power circuit, between the branched circuit region and the cylinder or engine, for interrupting power to the engine without interrupting power to the plurality of parallel circuits.

DESCRIPTION OF THE DRAWINGS

In the accompanying drawings which illustrate embodiments of the invention.

DETAILED DESCRIPTION OF THE INVENTION

Before the present invention is disclosed and described, it is to be understood that this invention is not limited to the particular configurations, process steps and materials disclosed herein as these may vary to some degree. It is also to be understood that the terminology used herein is used for the purpose of describing particular embodiments only, and is not intended to be limiting as the scope of the present invention. The invention will be limited only by the appended claims and equivalents thereof.

Figure 1:
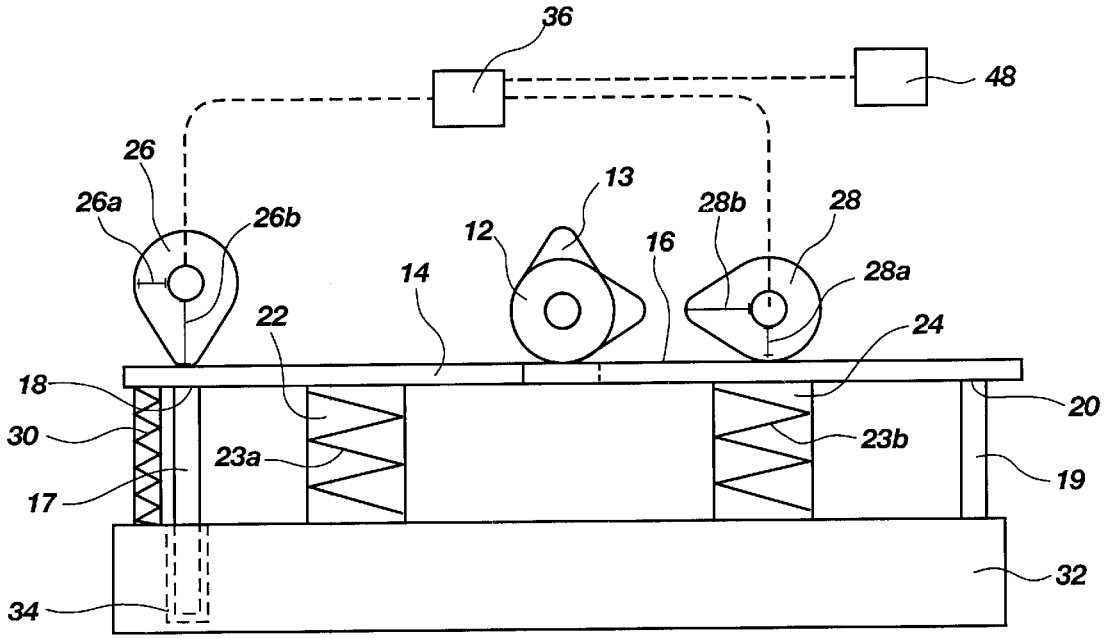
FIGS. 1 and 2 is a schematic drawing of an embodiment of the present invention applied to an overhead cam system.

Referring to FIG. 1, a schematic view of an overhead cam embodiment of the present invention is shown wherein the accompanying cylinder (not shown) is in operational condition. As is typical in an overhead cam system, a cam shaft 12 is positioned above the cylinder. During normal operation, as the cam shaft 12 rotates, raised areas or ridges 13 on the cam shaft 12 cause a first rocker arm 14 and a second rocker arm 16 to pivot in relation to a first fulcrum point 18 of a first fulcrum 17 and a second fulcrum point 20 of a second fulcrum 19, respectively. As the first and second rocker arms 14, 16 are caused to pivot by the cam shaft 12, an intake valve 22 and an exhaust valve 24 are opened and closed at appropriate times for normal operation as is known in the art. The valves 22, 24 are biased by valve springs 23*a*, 23*b* such that when the cam shaft 12 is not pivoting the rocker arms 14, 16, the valves are biased in an extended closed position.

Normal operation is effectuated as a first auxiliary cam 26 is positioned such that a larger radial position 26*b* is selected rather than a smaller radial position 26*a*. Additionally, a second auxiliary cam 28 is positioned such that a smaller radial position 28*a* is selected over a larger radial position 28*b*. Thus, when the auxiliary cams 26, 28 are positioned as shown, normal operation of the overhead cam cylinder occurs. A fulcrum spring 30 is compressed while the overhead cam system is in its normal operational condition. Though the fulcrum spring 30 is shown next to the fulcrum 17, one skilled in the art would recognize that other biasing mechanisms and/or locations may be used including placement of the spring around the fulcrum 17, or beneath the fulcrum 17 in a cavity 34 within the cylinder housing 32. In this embodiment, the first fulcrum point is attached to the first rocker arm and can slide in and out of the cavity 34, depending on the position of the first auxiliary cam 26.

The first and second auxiliary cams 26, 28 can be rotated by a switch 36. The switch can be any mechanism that effectuates turning of the first and second auxiliary cams 26, 28 between large radial positions and small radial positions. Such switches can include levers; cable systems, electric switches, hydraulic switches, computer controlled switches, solenoids, or other switches known by those skilled in the art. However, the switch only requires power (human, electrical, etc.) while the auxiliary cams 26, 28 are being rotated. Once in place, no power is required to maintain the position of the auxiliary cams 26, 28, and thus, no power is required to maintain the position of the valves 22, 24. The valves 22, 24 are fixed mechanically. Additionally, whatever switch type is used, if the engine is fuel injected, then the fuel injector 48 for the cylinder that is being disabled can preferably also be disabled when the when the cylinder is disabled as described in FIG. 2 below.

Figure 2:
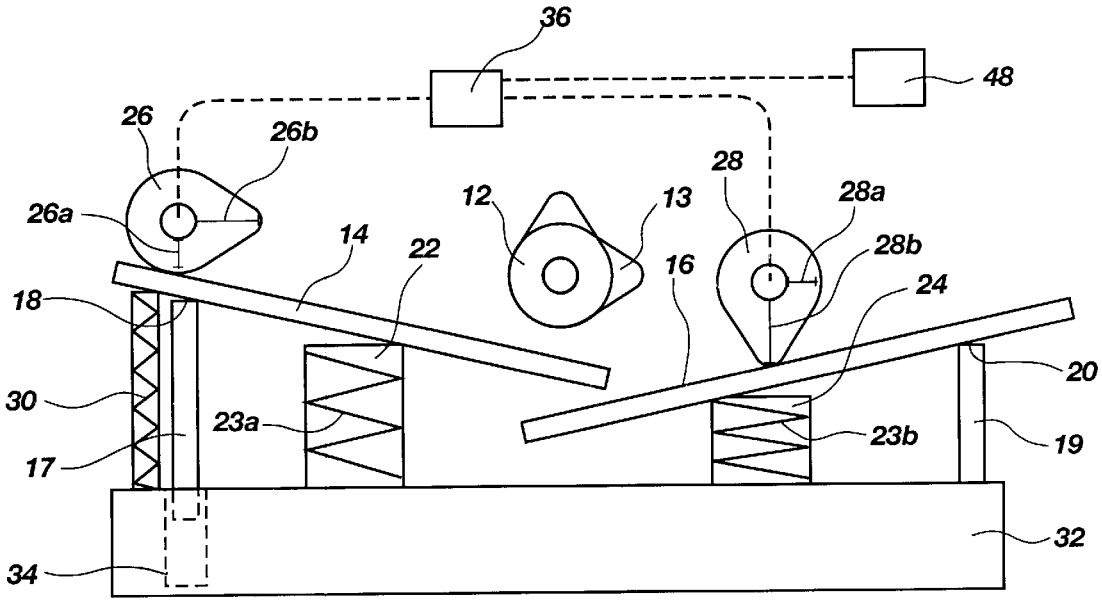

Turning now to FIG. 2, a schematic view of the overhead cam system of FIG. 1 is shown wherein the accompanying cylinder (not shown) is in a disabled condition. To disable the cylinder in accordance with the present invention, the first auxiliary cam 26 is rotated mechanically from the larger radial position 26*b* to the smaller radial position 26*a*. Thus, the fulcrum spring 30 raises the fulcrum point 18 of the first rocker arm 14 such that the raised ridges 13 on the cam shaft 12 do not functionally contact the rocker arm. Thus, as the first rocker arm 14 is no longer being acted upon by the raised ridges 13 of the spinning cam shaft 12, the bias of the valve spring 23*a* on the intake valve 22 holds the intake valve 22 in a closed position.

The exhaust valve 24 is held in a fixed open position as the second auxiliary cam 28 is rotated from a smaller radial position 28*a* to a larger radial position 28*b*. Thus, the exhaust valve 24 is held open mechanically as the second rocker arm 16 is pressed against the exhaust valve 24 in a fixed position. Again, the spinning cam shaft 12 has little or no effect on the second rocker arm 16 while in this position.

By simultaneously (or in close proximity of time) positioning the first and second auxiliary cams 26, 28 in this configuration, no appreciable vacuum loss occurs or no fuel or air may enter the cylinder as the intake valve 22 is biased in a closed position. Additionally, the piston in the cylinder is allowed to move up and down without creating significant positive or negative pressure due to the fact that the exhaust valve 24 remains open.

Figure 3:
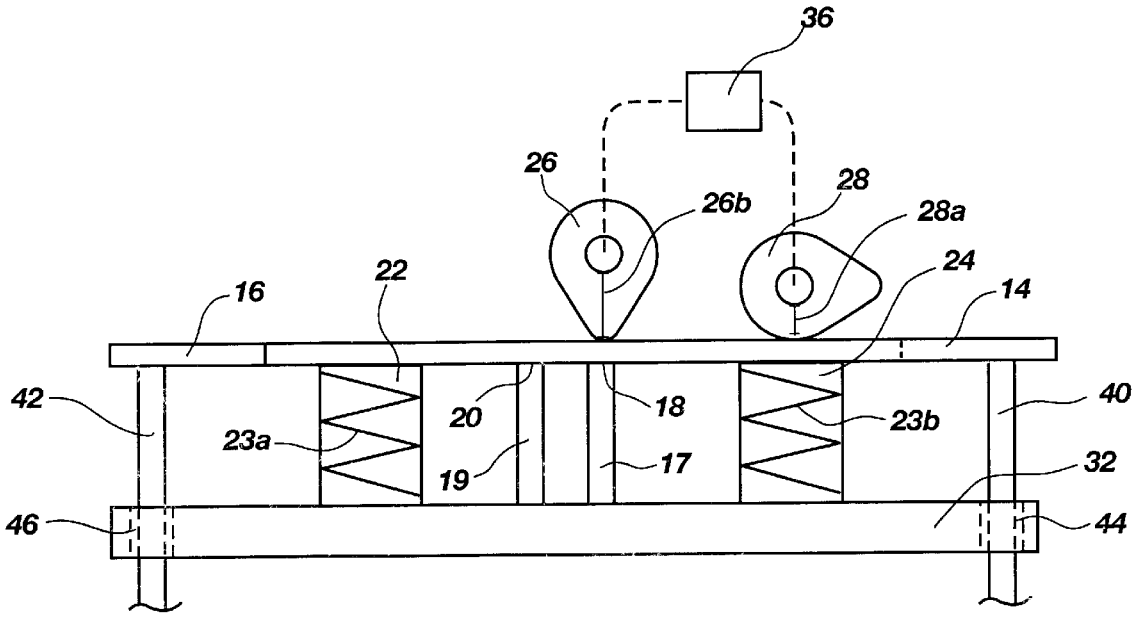
FIGS. 3 and 4 is a schematic drawing of an embodiment of the present invention applied to a standard cam system.

Turning now to FIG. 3, a schematic view of a standard cam embodiment of the present invention is shown wherein the accompanying cylinder (not shown) is in an operational condition. In this embodiment, the first and second auxiliary cams 26, 28 are again positioned to effect the first and second rocker arms 14, 16 respectively. Specifically, the first auxiliary cam 26 is positioned in the Larger radial position 26*b* such that the first rocker arm 14 is held against the first fulcrum point 18 (as the first rocker arm 14 can by removed from contact with the first fulcrum point, or more preferably, the fulcrum point can move with the first rocker arm by means of a biasing device such as a spring as shown in FIGS. 1 and 2). Thus, when a first push rod 40 is pushed through a first cavity 44, the first rocker arm 14 pivots at the first fulcrum point 18 causing the intake valve 22 to open. A valve spring 23*b* biases the exhaust valve to a closed position when the first push rod 40 is shortened above the top of the cylinder housing 32. With respect to the exhaust valve 24, the second auxiliary cam 28 is positioned in the smaller radial position 28*a*. Thus, because the second rocker arm 16 is pivotally fixed to the second fulcrum point 20, when the second push rod 42 is pushed through a second cavity 46 and is elongated with respect to the top of the cylinder housing 32, the exhaust valve 24 is depressed and opened. Thus, for normal operation of the cylinder, the first and second auxiliary cams can be positioned as shown.

Figure 4:
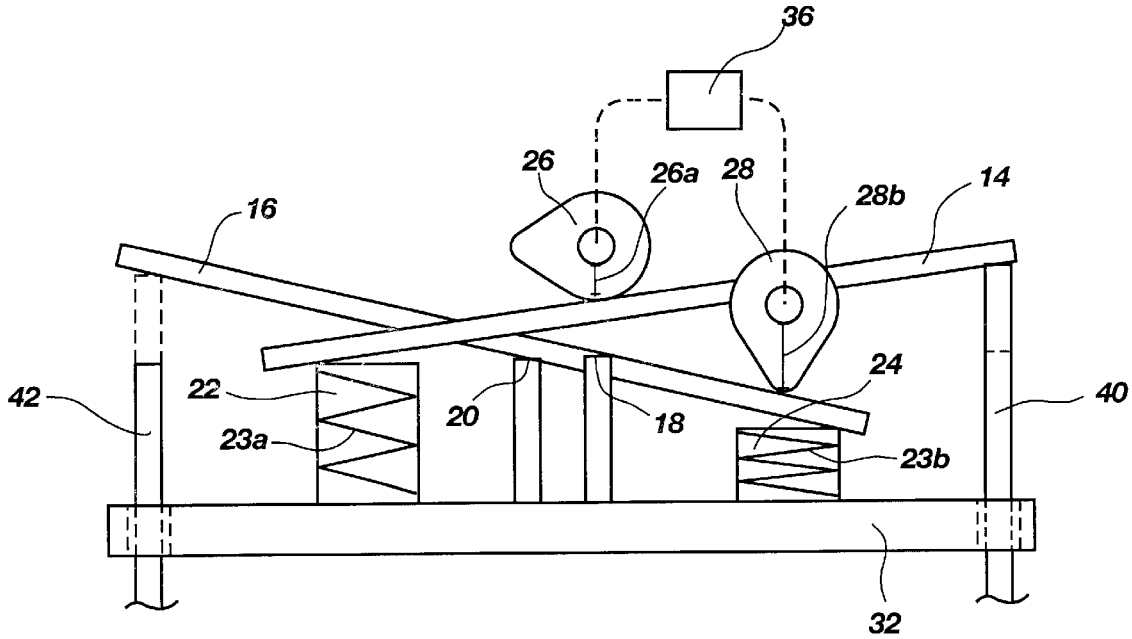

In FIG. 4, a schematic view of the standard cam system of FIG. 3 is shown wherein the accompanying cylinder (not shown) is in a disabled condition. The cylinder is disabled as the intake valve 22 remains closed and the exhaust valve 24 is held open. This is accomplished by rotating the first auxiliary cam 26 to the smaller radial position 26*a* and the second auxiliary cam to the larger radial position 28*b*.

By rotating the first auxiliary cam 26 to the position shown, the first rocker arm can be removed from the first fulcrum point 18 when the first push rod 40 is elongated above the housing 32. However, more preferably, the first fulcrum point can also be coupled to the first rocker arm in a similar manner as shown in FIGS. 1 and 2. Specifically, a biasing device such as a spring can be coupled to the first fulcrum 17 such that the first rocker arm away is pushed away from the top of the cylinder, and yet maintain contact with fulcrum point 18 when the first auxiliary cam 26 is in the small radial position 26*a*. Additionally, a cavity (similar to that shown in FIGS. 1 and 2) in the top of the cylinder 32 can be in place to allow shortening and extending of the first fulcrum 17 above the cylinder top 32. This is preferred so that the first rocker arm can be maintained in a controllable position at all times. In either case, the intake valve 22 is not forced to an open position at any time. In other words, because the valve spring 23*a* biases the intake valve 22 closed, and because the force of the first rocker arm 14 is functionally removed from the intake valve 22, the intake valve remains closed and will not allow air or fuel into the cylinder. By rotating the second auxiliary cam 28 to the position shown, the exhaust valve is mechanically held open and the second rocker arm 16 is pivoted to a position such that the second push rod 42 cannot act upon it in such a manner as to allow it to close.

Figure 5:
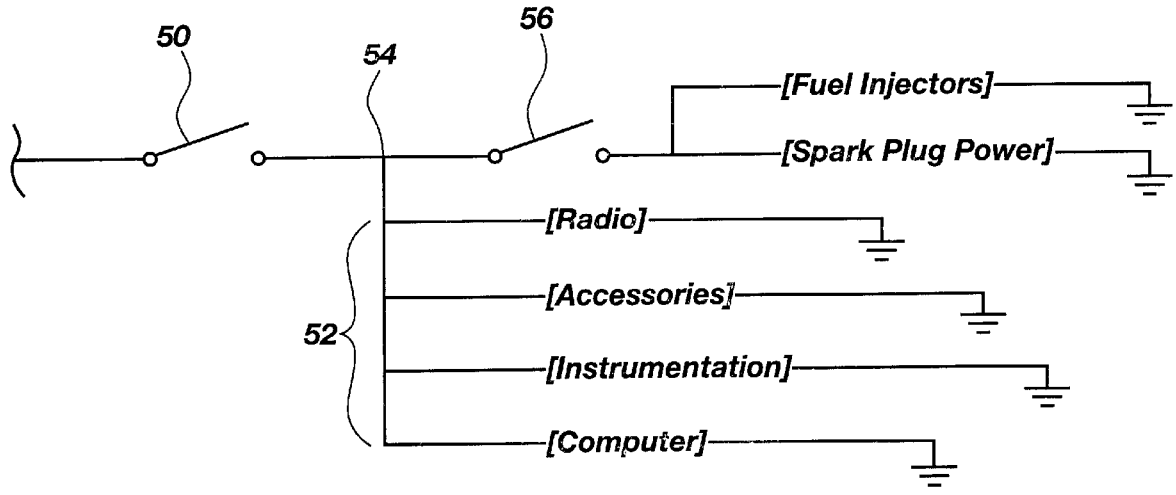
FIG. 5 is a schematic drawing of a circuit for electrically disabling a cylinder or engine while maintaining power to other operational loads.

Turning now to FIG. 5, an embodiment of a circuit for disabling power to an engine system(s) while maintaining power to other operational loads is shown. An ignition switch 50 is shown which, when closed, allows power to reach a plurality of parallel circuits 52 which are electrically coupled to the ignition switch 50. The plurality of parallel circuits 52 are configured to branch from a common branched circuit region 54. In parallel to the plurality of parallel circuits 52, and branching from the common branched circuit region 54, is an spark plug power circuit which electrically couples the engine to the ignition switch 50. An interrupter switch 56 is positioned between the branched circuit region 54 and the engine (on the spark plug power circuit) such that when the interrupter switch 56 is disengaged, power to the engine systems (not shown) is cut off. However, power is maintained to the plurality of parallel circuits 52. If the engine is fuel injected, then the fuel injector for the cylinder that is being electrically disable is preferably also disabled when the interrupter switch 56 is disengaged.

Figure 6:
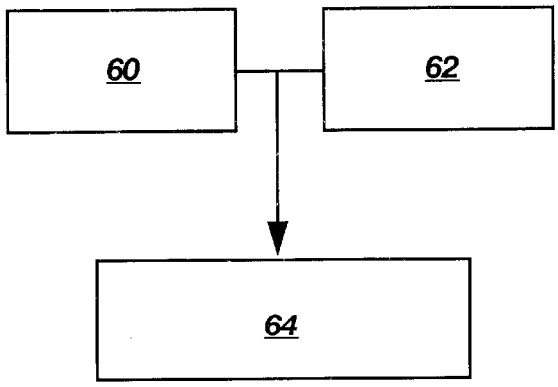
FIG. 6 is a schematic flow diagram of a method of the present invention

In FIG. 6, a method of disabling at least one cylinder for at least one complete engine cycle in a multiple cylinder combustion engine is disclosed comprising multiple steps. In this embodiment, the fuel combustion air intake valve is closed 60 such that at least one cylinder essentially allows no fuel enter. In close proximity of time (i.e., within an engine cycle before, simultaneously, or within an engine cycle after) the exhaust valve associated with the at least one cylinder is opened 62 such that piston movement within the cylinder is essentially unimpeded. Once both the exhaust valve is opened 62 and the intake valve is closed 60, at least one complete engine cycle 64 is allowed to occur.

With these preferred embodiments in mind, a method of disabling at least one cylinder for at least one complete engine cycle in a multiple cylinder combustion engine comprising the steps of a) closing a fuel combustion air intake valve associated with at least one cylinder such that essentially no fuel enters the at least one cylinder; b) opening an exhaust valve associated with the at least one cylinder such that piston movement within the cylinder is essentially unimpeded; and c) allowing at least one complete engine cycle to occur while both the fuel combustion air intake valve is closed and the exhaust valve is open. Additionally, a system for disabling at least one cylinder in a multiple cylinder combustion engine is disclosed which comprises a) a first rocker arm associated with opening and closing of a fuel combustion air intake valve, wherein the first rocker arm has an operational position and a disabled position; b) a second rocker arm associated with opening and closing of an exhaust valve, said second rocker arm having an operational position and a disabled position; and c) a switch for toggling the first and second rocker arms from their respective operational positions to their respective disabled positions.

The present system and method is preferably operated such that the fuel combustion air intake valve is closed by removing a first rocker arm associated with opening and closing the fuel combustion air intake valve from functional contact with the fuel combustion air intake valve. Removing the rocker arm from functional contact with the valve does not mean to remove the rocker arm from any contact with the valve. In other words, the rocker arm can still contact the valve, it just cannot cause the valve to open and close as is the case under normal operating conditions. Such removal from functional contact is accomplished by adjusting the position of the first rocker arm from a proximal position to a distal position in relation a first fulcrum point. Thus, the first fulcrum point does not act on the first rocker arm in such a way as to cause normal fuel combustion air intake valve operation.

A preferred method of removing the first rocker arm from functional contact with the fuel combustion air intake valve by turning a first auxiliary cam from a larger radial position to a smaller radial position. The first auxiliary cam is positioned in relation to the first rocker arm and the first fulcrum point such that, while the first auxiliary cam is in the larger radial position, the first rocker arm is held against the first fulcrum point facilitating normal operation.

Conversely, the exhaust valve is preferably held open by forcing pressured contact with a second rocker arm associated with opening and closing the exhaust valve. In other words, the exhaust valve is held open by disabling a second rocker arm such that the second rocker arm is held in a position wherein the exhaust valve is depressed. In one embodiment, the second rocker arm is disabled by turning a second auxiliary cam from a smaller radial position to a larger radial position. The second auxiliary cam is located in relation to the second rocker arm and the exhaust valve such that when the second auxiliary cam is turned to the larger radial position, direct force is placed upon the second rocker arm and the exhaust valve, disabling the second rocker arm and holding the exhaust valve open, respectively.

Such methods or systems are preferably operated manually by the driver by a switch such as a lever, a cable system, or some other mechanical switch. However, other switches may be used including an electric switch, a hydraulic switch, a computer controlled switch, a solenoid, or other switches known by those skilled in the art. No matter what type of switch is used to disable and enable the intake and exhaust valves as described, it is preferred that they be disabled essentially simultaneously (i.e., within one engine cycle of the other). One advantage of the auxiliary cam system as described is that once the auxiliary cams are positioned in the appropriate position to disable the cylinder, no additional power is required to maintain the cylinders in the disabled position. Therefore, even if a solenoid is used, it is used merely to change the mechanical position of the auxiliary cams and then will require no power until the auxiliary cams are to be moved back to their original position.

This system and method can be utilized with a normally aspirated engine or a fuel injected engine. However, if a fuel injection engine is used, then the fuel injector for the cylinder to be shut down should also be disabled. In other words, any additional fuel input device independent of the fuel combustion air intake valve should be disabled.

If the desire is to electrically remove power to some or all cylinders, while maintaining power to other systems, a circuit for disabling power to an engine or specific cylinders while maintaining power :0o other operational loads may be used. This circuit is comprised of a) an ignition switch; b) a plurality of parallel circuits electrically coupled to the ignition wherein the plurality of circuits branch out from a common branched circuit region; c) a parallel spark plug power circuit (with respect to the plurality of parallel circuits) which electrically couples a cylinder or engine to the ignition switch wherein the spark plug power circuit likewise branches out from the common branched circuit region; and d) an interrupter switch positioned between the branched circuit region and the cylinder or engine for interrupting power to the cylinder or engine without interrupting power to the plurality of parallel circuits. If a fuel input device is in place, the circuit associated with the fuel input device should be disabled when the interrupter switch has disabled the cylinder or engine. However, a normally aspirated may also be used. In one embodiment, the interrupter switch is operated from the dash board manually, though a computer controlled mechanism can also be used.

While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims.

I claim:

1. A method of disabling at least one cylinder for at least one complete engine cycle in a multiple cylinder combustion engine comprising the steps of:

a) closing a fuel combustion air intake valve associated with at least one cylinder such that essentially no fuel enters the at least one cylinder by removing a first rocker arm associated with opening and closing the fuel combustion air intake valve from functional contact with the fuel combustion air intake valve by turning a first auxiliary cam from a larger radial position to a smaller radial position;

b) opening an exhaust valve associated with the at least one cylinder such that piston movement within the cylinder is essentially unimpeded; and c) allowing at least one complete engine cycle to occur while both the fuel combustion air intake valve is closed and the exhaust valve is open.

2. The method of claim 1 further comprising the steps of closing the fuel combustion air intake valve and opening the exhaust valve with a manually operated switch.

3. The method of claim 1 further comprising the steps of injecting the engine with fuel and then disabling any fuel input device independent of the fuel combustion air intake valve.

4. The method of claim 1 wherein the engine is normally aspirated.

5. A method of disabling at least one cylinder for at least one complete engine cycle in a multiple cylinder combustion engine comprising the steps of:

a) closing a fuel combustion air intake valve associated with at least one cylinder such that essentially no fuel enters the at least one cylinder;

b) opening an exhaust valve associated with the at least one cylinder such that piston movement within the cylinder is essentially unimpeded, said exhaust valve being opened by disabling a second rocker arm and holding the exhaust valve open such that the exhaust valve is depressed, and wherein the step of holding the exhaust valve open is accomplished by turning a second auxiliary cam from a smaller radial position to a larger radial position; and c) allowing at least one complete engine cycle to occur while both the fuel combustion air intake valve is closed and the exhaust valve is open.

6. The method of claim 5 further comprising the steps of closing the fuel combustion air intake valve and opening the exhaust valve with a manually operated switch.

7. The method of claim 5 further comprising the steps of injecting the engine with fuel and then disabling any fuel input device independent of the fuel combustion air intake valve.

8. The method of claim 5 wherein the engine is normally aspirated.

9. A system for disabling at least one cylinder in a multiple cylinder combustion engine comprising:

a) a first rocker arm associated with opening and closing of a fuel combustion air intake valve, said first rocker arm having an operational position and a disabled position;

b) a first auxiliary cam having a larger radial position and a smaller radial position, wherein when the first auxiliary cam is in the smaller radial position, the first rocker arm is in the disabled position;

c) a second rocker arm associated with opening and closing of an exhaust valve, said second rocker arm having an operational position and a disabled position; and d) a switch for toggling the first and second rocker arms from their respective operational positions to their respective disabled positions.

10. The system of claim 9 further comprising:

a) a fuel input device with an electrical control for the injection of fuel into the cylinder independent of the fuel combustion air intake valve; and b) a fuel switch for disabling the fuel input device at the same time as the fuel combustion air intake valve and the exhaust valve are in their respective disabled positions.

11. The system of claim 9 wherein the engine is normally aspirated.

12. The system of claim 9 wherein the engine is fuel injected.

13. The system of claim 1 wherein the switch is selected from the group consisting of an electrical switch, a lever, a cable, a computer controlled switch, a solenoid, and a hydraulic switch.

14. The system of claim 9 wherein the first rocker arm is in the disabled position as said first rocker arm is removed from functional contact with the fuel combustion air intake valve such that the fuel combustion air intake valve remains closed.

15. The system of claim 9 wherein the second rocker arm is in the disabled position as said second rocker arm is fixed in a position such that the exhaust valve is depressed.

16. A system for disabling at least one cylinder in a multiple cylinder combustion engine comprising:

a) a first rocker arm associated with opening and closing of a fuel combustion air intake valve, said first rocker arm having an operational position and a disabled position;

b) a second rocker arm associated with opening and closing of an exhaust valve, said second rocker arm having an operational position and a disabled position;

c) a second auxiliary cam having a larger radial position and a smaller radial position wherein when the second auxiliary cam is in the larger radial position, the second rocker arm is in the disabled position; and d) a switch for toggling the first and second rocker arms from their respective operational positions to their respective disabled positions.

17. The system of claim 16 further comprising:

a) a fuel input device with an electrical control for the injection of fuel into the cylinder independent of the fuel combustion air intake valve; and b) a fuel switch for disabling the fuel input device at the same time as the fuel combustion air intake valve and the exhaust valve are in their respective disabled positions.

18. The system of claim 16 wherein the engine is normally aspirated.

19. The system of claim 16 wherein the engine is fuel injected.

20. The system of claim 16 wherein the first rocker arm is in the disabled position as said first rocker arm is removed from functional contact with the fuel combustion air intake valve such that the fuel combustion air intake valve remains closed.

21. The system of claim 16 wherein the second rocker arm is in the disabled position as said second rocker arm is fixed in a position such that the exhaust valve is depressed.

* * * * *